US007165364B2

(12) United States Patent
Inelli

(10) Patent No.: US 7,165,364 B2
(45) Date of Patent: Jan. 23, 2007

(54) WINDOW SLEEVE FOR MOUNTING FRAMED WINDOWS

(76) Inventor: John D. Inelli, 620 Market St., Newark, NJ (US) 07105

( * ) Notice: Subject to any disclaimer, the term of this patent is extended or adjusted under 35 U.S.C. 154(b) by 5 days.

(21) Appl. No.: 10/676,048

(22) Filed: Oct. 2, 2003

(65) Prior Publication Data

US 2005/0072073 A1 Apr. 7, 2005

(51) Int. Cl.
*E06B 3/00* (2006.01)

(52) U.S. Cl. ..... 52/208; 52/204.1; 52/211; 52/215

(58) Field of Classification Search ..... 52/208, 52/204.53, 204.55, 204.1, 211, 656.2, 656.5, 52/734.1, 734.2, 215, 201
See application file for complete search history.

(56) References Cited

U.S. PATENT DOCUMENTS 3,768,220 A * 10/1973 Riegelman, Jr. ..... 52/208
4,624,091 A * 11/1986 Biro ..... 52/656.5
5,557,894 A * 9/1996 Card ..... 52/204.595
5,678,367 A * 10/1997 Kline ..... 52/211
6,055,782 A * 5/2000 Morton et al. ..... 52/204.1
6,298,614 B1 * 10/2001 Fisher ..... 52/204.1
6,334,283 B1 * 1/2002 Edger ..... 52/204.1
6,513,854 B1 * 2/2003 Lagrue et al. ..... 296/93
6,745,523 B1 * 6/2004 Petta ..... 52/213

* cited by examiner

*Primary Examiner*—Naoko Slack
*Assistant Examiner*—Jonathan T. Junker
(74) *Attorney, Agent, or Firm*—Millen, White, Zelano & Branigan, P.C.

(57) ABSTRACT

A window sleeve arrangement for positioning a window unit in an opening through an enclosure wall has an interior surface for receiving the window unit and an outside surface for sliding into the opening through the enclosure wall. A first exterior flange engages the exterior surface of the enclosure wall, while a second exterior flange, spaced from the first exterior flange provides a gap for receiving sheathing on the outside of the building. Disposed within the window sleeve arrangement is an interior inwardly projecting flange which serves as a window stop to position the window adjacent the exterior wall of the building enclosure. The window unit is held within the window sleeve by a snap-in-place molding which engages the window unit. Optionally, interior decorative molding is coupled to the sleeve to cover a portion of the interior wall adjacent to the window sleeve. Preferably, the window sleeve assembly is made of plastic material, such as polyvinylchloride, polyurethane, polypropylene, ABS composite, ABS cellular plastics, plastic composites, cellular plastics or any other type of suitable plastic material.

23 Claims, 7 Drawing Sheets

WINDOW SLEEVE FOR MOUNTING FRAMED WINDOWS

FIELD OF THE INVENTION

The present invention is related to devices for mounting framed windows. More particularly, the present invention is related to devices for mounting framed windows through openings in walls, wherein the devices are configured as window sleeve arrangements surrounding framed windows.

BACKGROUND OF THE INVENTION

Quickly and conveniently mounting framed windows within a wall of an enclosure, such as the exterior wall of a building, is a task which needs improvement because installing windows is a labor intensive undertaking which involves considerable expense. Moreover, installing windows requires a level of skill that many installers lack, so that windows are improperly installed resulting in leaks wherein, not only water, but air passes between the window frame and opening though the wall in which the window is mounted. Leaks not only compromise the thermal efficiency of buildings, but also can result in water damage within buildings and to building walls, which damage over time can be very expensive to repair.

In view of the aforementioned considerations, there is a need for a more reliable, less labor intensive and therefore less expensive approach to mounting framed windows.

SUMMARY OF THE INVENTION

In view of the aforementioned considerations, the present invention is directed to a window sleeve arrangement for positioning a window unit in an opening through an enclosure wall having an exterior surface and an interior surface, wherein the enclosure wall separates an interior space defined by the enclosure from an exterior space, the window unit having a frame surrounding at least one glass pane. The window sleeve comprises top and bottom walls joined by side walls. The walls each have an inner surface and an outer surface with an inner edge for positioning adjacent to the interior surface of the building wall and an outer edge for positioning adjacent to the exterior surface of the building wall. A first exterior flange is disposed around the walls of the sleeve and extends laterally inward from the outer surfaces of the walls at a location intermediate the inner and outer edges of the walls. The first outer flange engages and is secured to the exterior surface of the building wall to retain the sleeve within the opening. A second outer flange is located substantially at the outer edges of the walls and is spaced from the first outer flange defining a gap there between, which gap receives an outer covering over the exterior surface of the wall of the building. An inner flange is disposed adjacent to the outer edges of the walls and extends inwardly from the inner surfaces of the walls. The inner flange forms a stop for engaging the window unit to position the window unit within the sleeve in proximity with the exterior surface of the building enclosure wall. An inside stop arrangement is positioned in spaced relation to the inner flange to define a space there between for locating the window unit and for holding the window unit against the inner flange.

In a further aspect of the invention, the inner stop arrangement comprises a groove in the inner wall for receiving projections from a molding strip arrangement, the molding strip arrangement being constructed and arranged for engaging the window frame.

In a further aspect of the invention, the window sleeve is made of plastic material such as, but not limited to, polyvinylchloride or polyurethane.

In an additional aspect of the invention the inner surfaces of the walls extending from the inner edge of the inner flange are planar and unobstructed and the shape and size of the space defined by the inner surfaces of the walls complements the shape and size of the window unit.

In still a further aspect of the invention, the outer surfaces of the walls of the window sleeve arrangement are planar and unobstructed, complementing the opening through the enclosure wall.

In still another aspect of the invention, the inner stop arrangement comprises molding which is snapped into place on the walls and engages in window unit to hold the window unit in position.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
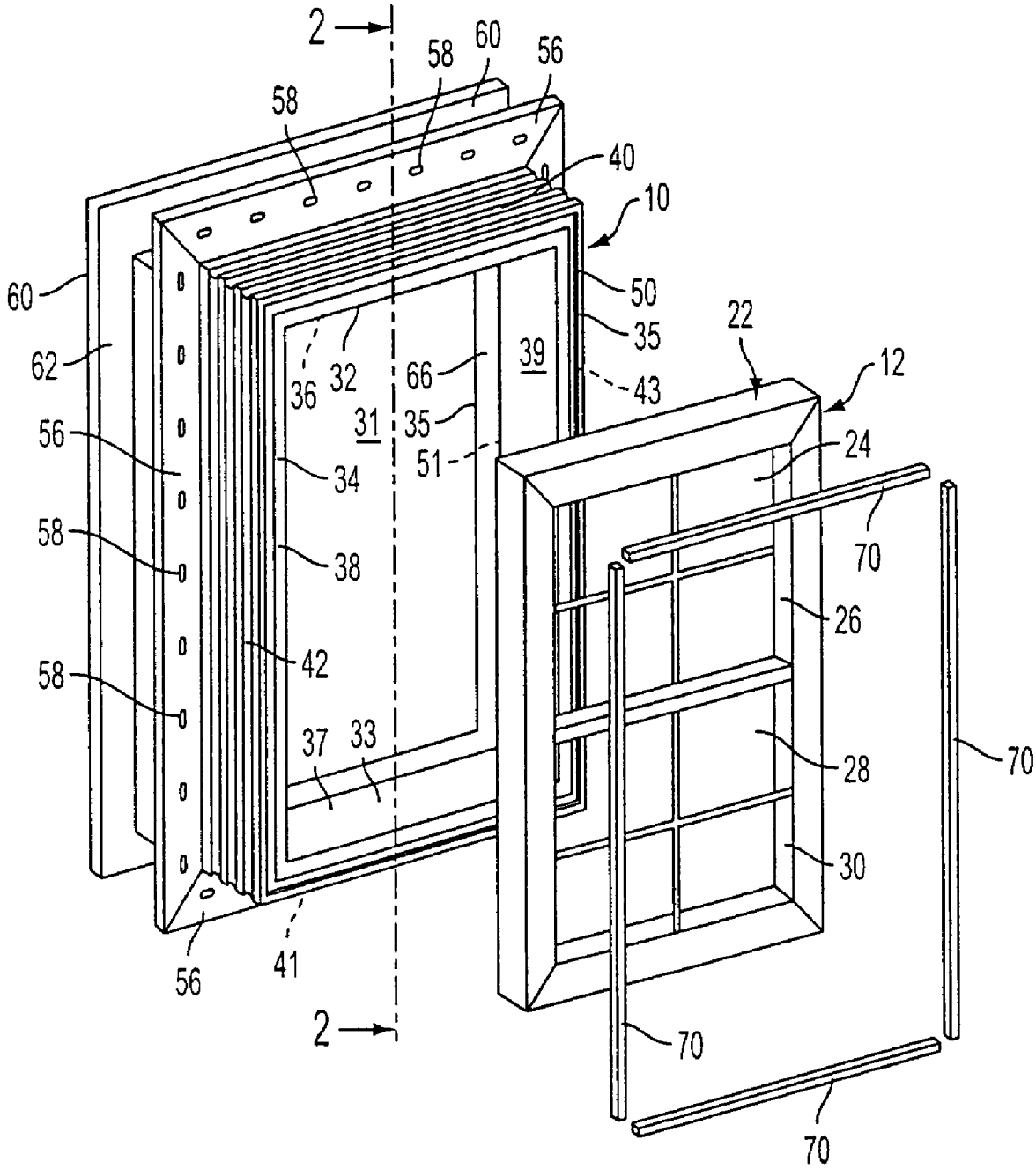
FIG. 1 is an exploded perspective view of a window sleeve arrangement in accordance with the present invention.
Figure 2:
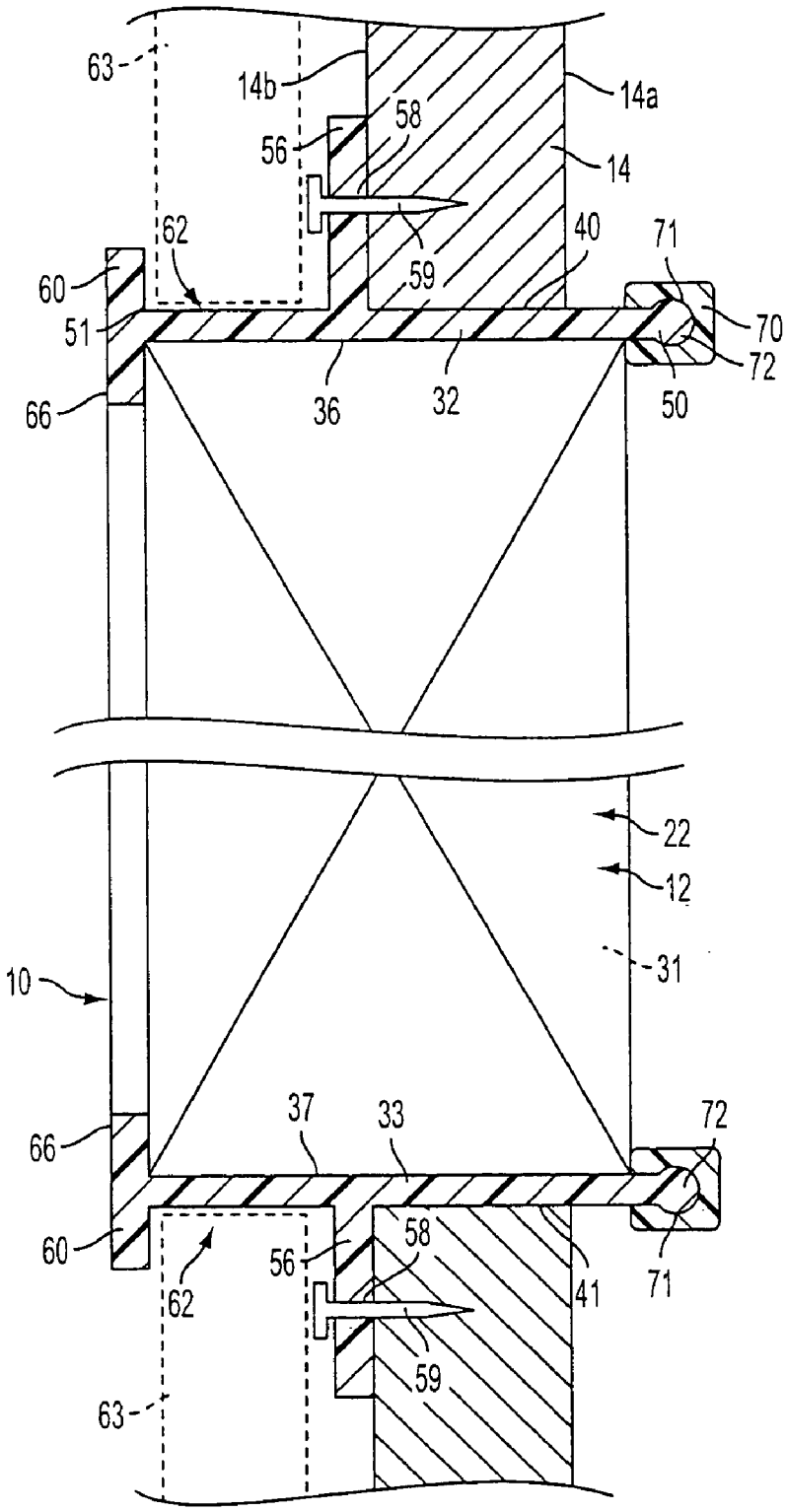
FIG. 2 is a side elevation taken along lines 2—2 of FIG. 1.
Figure 3:
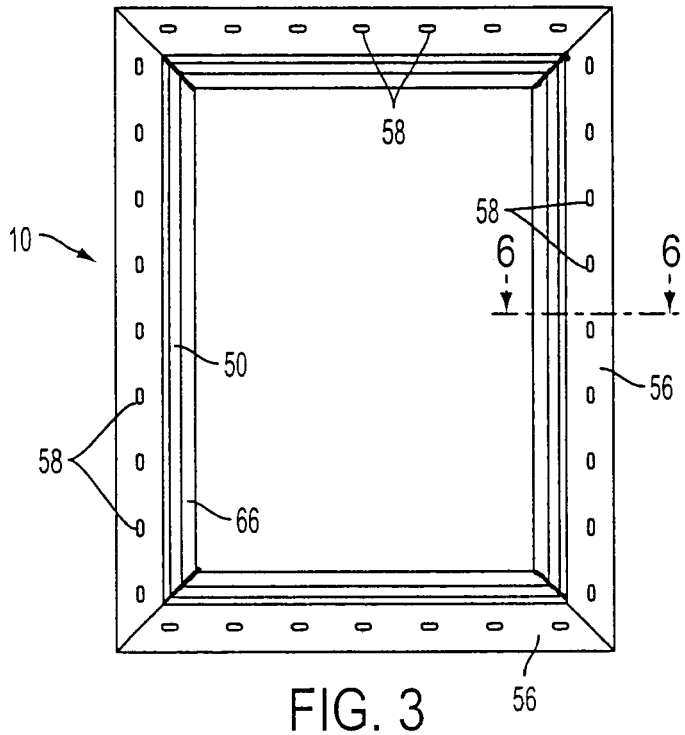
FIG. 3 is an inside planar view of a window sleeve used in the arrangement of FIGS. 1 and 2.

Referring now to FIGS. 1–3 there is shown a window sleeve arrangement 10 which is configured to receive a window unit 12 therein. As is seen in FIG. 2, the window sleeve arrangement 10 is mounted in an opening 13 through a building wall 14, the building wall having an interior surface 14*a* and an exterior surface 14*b* (usually on sheathing) which separates an interior space 16 of a building from the exterior environment 18.

Referring mainly to FIG. 1, the window unit 12 includes a window frame 22 in which is mounted at least one window pane. In a first embodiment, the window frame 22 has window panes 24 and 28 mounted therein with the window pane 24 mounted in the sash 26 and the window pane 28 mounted in a sash 30. The rectangular window frame 22 is received within a rectangular enclosure 31 of the window sleeve 10 defined by an upper wall 32 which is joined to a lower wall 33 by first and second side walls 34 and 35. The walls 32, 33, 34 and 35 have inner wall surfaces 36, 37, 38 and 39, respectively, and outer wall surfaces 40, 41, 42 and 43, respectively. The walls 32, 33, 34 and 35 define an inside edge 50 and an outside edge 51, the inside edge 50 being adjacent the interior wall surface 14*a* and the outside edge 51 being adjacent the outside surface 14*b* of the enclosure wall 14.

Figure 4:
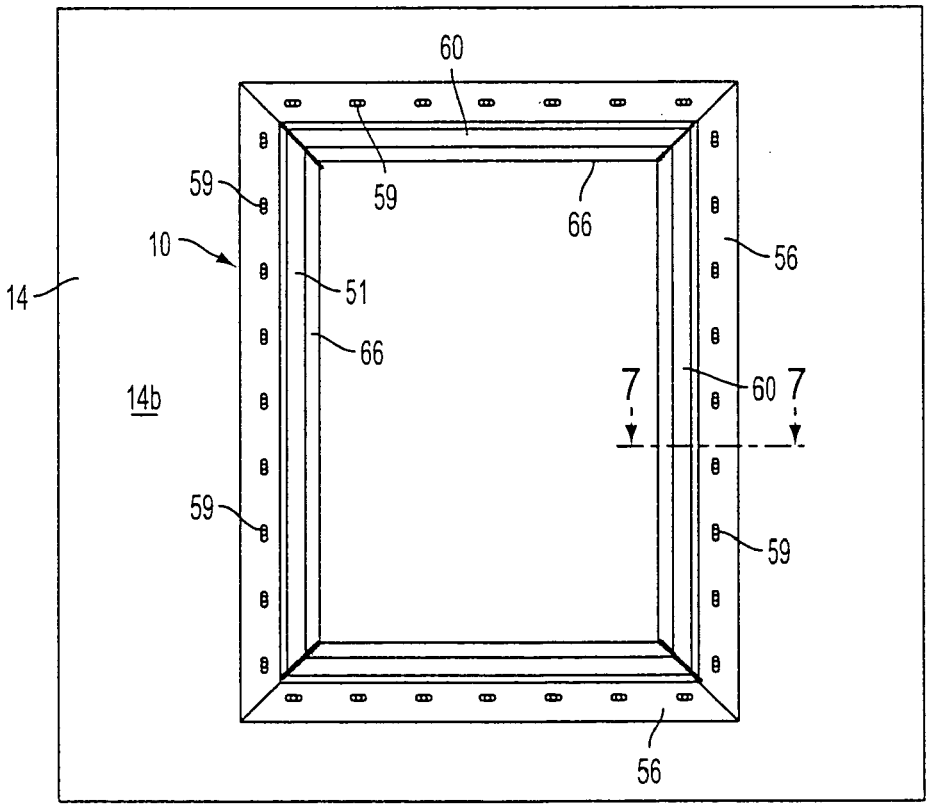
FIG. 4 is an outside view of the sleeve assembly mounted in an opening through an enclosure wall.

In order to secure the window sleeve arrangement 10 in the opening 13 (FIG. 2) through the enclosure wall 14, while positioning the window sleeve arrangement at a proper depth in the wall, a first laterally extending flange 56 extends outwardly from the outer wall surfaces 40, 41, 42 and 44 of the sleeve 10 at a location intermediate the inner edges 50 and outer edges 51 of the walls 32, 33, 34 and 35. The first outer flange 56 is secured to the exterior surface 14*b* of the building wall 14 to retain the sleeve 10 within the opening 13 through the building wall 14. Preferably, the first exterior flange 56 has a plurality of perforations 58 for receiving screws or nails 59 in order to firmly secure the first exterior flange to the building wall 14 (see FIGS. 2 and 4). In another embodiment, the first exterior flange 56 is secured to the exterior surface 14*b* of the outer wall 14 by fasteners such as headed studs or staples which are mechanically driven therethrough. In another embodiment an adhesive is used in lieu of, or in combination with, separate fasteners such as nails, screws or studs.

Figure 5:
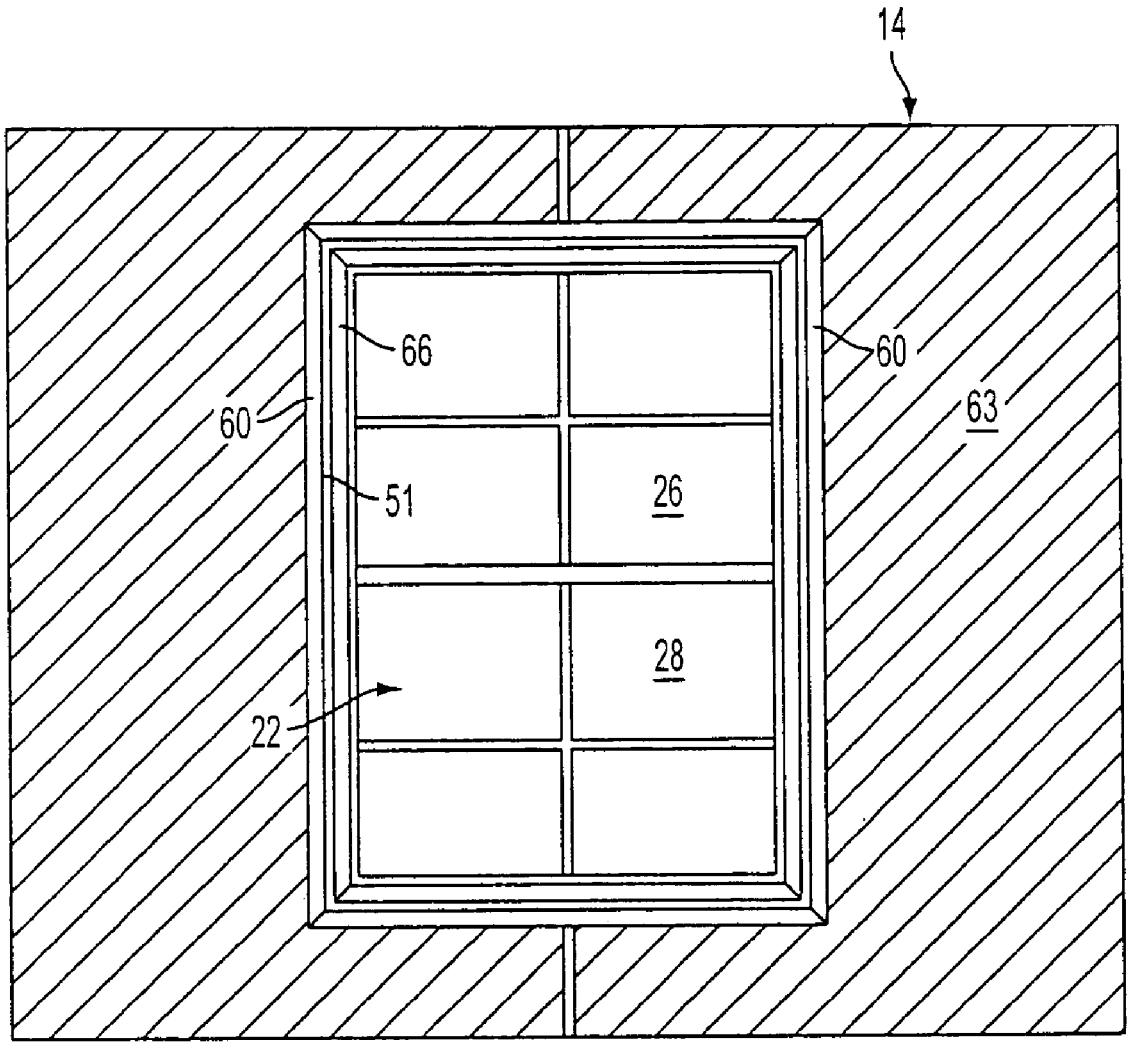
FIG. 5 is an exterior view showing a window unit mounted in the window sleeve of FIG. 3 and showing outer covering around the window unit and window sleeve arrangement.

Disposed at the outer edge 51 of the sleeve arrangement 10 is a second outer flange 60 that is separated from the first outer flange 56 by a gap 62 (see FIGS. 2 and 5). The gap 62 receives an exterior covering of the building, such as siding (dotted lines 63). In order to seal the second exterior flange 60 to the outer covering, a sealant is injected or squirted behind the second flange 60 and into the gap 62 prior to sliding the external covering or siding 63 into the gap.

An inner flange 66 is disposed adjacent to the outer edges 51 of the walls 32–35 and extends inwardly from the inner surfaces of the walls. The inner flange 66 provides a stop for engagement by the window unit 12 and positions the window unit within the sleeve 10 in proximity with the exterior surface 14*b* the building wall 14. A bead of sealant is preferably disposed between the window unit 12 and the inner flange 66 in order to seal the window unit 12 in place without substantially hindering removal of the window unit. If it is desired to remove the window unit 12 after installation, the window unit may simply be opened and the seal slit, whereupon the window unit may be slid out of the sleeve 10 by being pulled from the inside.

In order to positively hold the window unit 12 within the window sleeve 10, a molding 70 (see FIGS. 1 and 2) is attached either to the inner surface of the window sleeve or to the inside edge 50 of the window sleeve. The molding 70 may be nailed, held with screws, adhered with adhesive or snapped in place. In a first embodiment the molding 70 has a U-shaped groove 71 therein which receives a bead 72 on the inside edge 50 of the sleeve 10 snap-in molding is preferred in accordance with one embodiment. A molding portion 73 is used which projects forwardly toward the window unit 12 to engage the window unit, positively holding the window unit in place. Alternatively, the molding may be made of strips which have ribs that snap into slots formed in the surfaces of the walls 32–35 (see FIGS. 6 and 7).

Preferably, the inner surfaces of the walls 32–35 are planar and unobstructed so that window units 12 may readily slide therein during installation or replacement. In addition, for ease of mounting, the outer surfaces of the walls 40–43 extending rearwardly of the first exterior flange 56 may in one embodiment be smooth and unobstructed so that the window sleeve 10 can be easily mounted within the opening 13 formed through the building wall 14 to receive the window sleeve.

In a preferred embodiment, the window sleeve 10 is molded of a suitable plastic material. Examples of such materials are polyvinylchloride, polyurethane, polypropylene, acrylonitrile-butadiene-styrene (ABS), cellular plastics, composite plastics, or any other suitable plastic material. Preferably the plastic material is one which withstands temperature variation, moisture and sunlight.

The window sleeve 10 is configured to ease new construction as well as facilitate replacement of window units 12. Since as seen in FIG. 1, the window unit 12 is independent of the sleeve 10, the window units 12 may be of any style, and may for example have sliding sashes or pivoting sashes (FIGS. 1, 5 and 7), or may use fixed planes of glass. By utilizing the window sleeve 10, faster and more accurate construction of window openings is achieved, resulting in a decrease in expense as well as increased flexibility and reliability.

Figure 7:
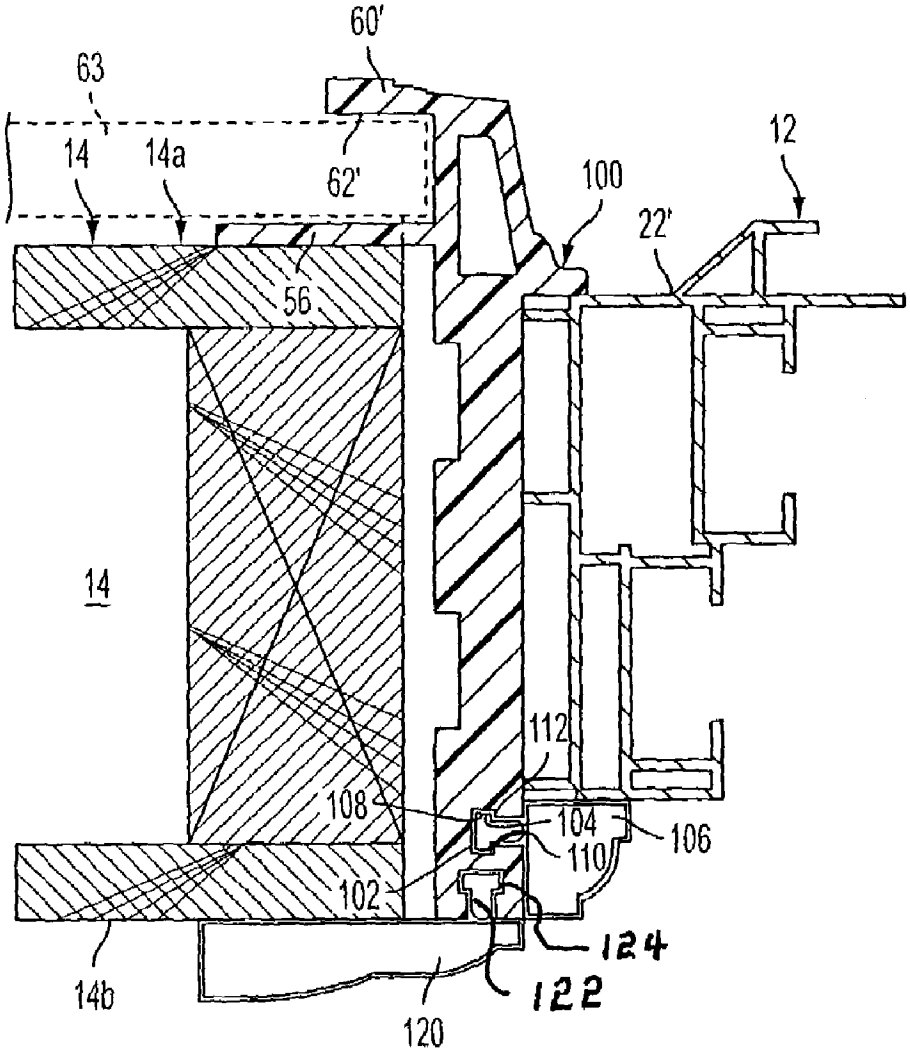
FIG. 7 is an elevation taken along lines 7—7 of FIG. 4.
Figure 6:
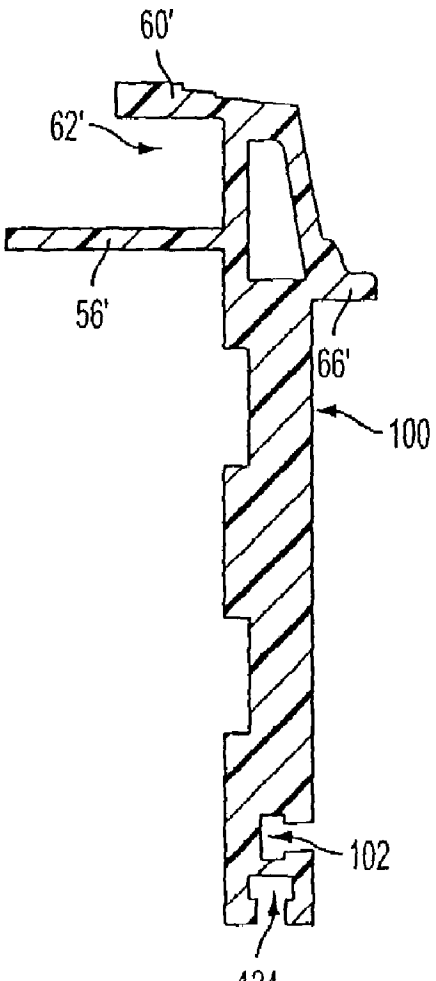
FIG. 6 is an elevation taken along lines 6—6 of FIG. 3 illustrating a preferred embodiment the widow sleeve.

Referring now to FIGS. 6 and 7 where a preferred embodiment 100 of the window sleeve is illustrated, it is seen that the window sleeve 100 has a relatively thick cross-section so as to accommodate a relatively deep groove 102, which receives a resilient latching member 104 projecting from molding 106. The resilient latching member 104 forms a snap-in coupling comprising two spring-arm strips 108, each having a shoulder 110 that snaps behind shoulders 112 at the entrance to the slot 102.

Optionally, a decorative interior molding 120 has a resilient latching rib 122 that snaps into and latches with a second groove 124 in the window sleeve 100. The resilient rib member 122 has a structure similar to the resilient latching rib member 104. The decorative interior molding 120 overlies the interior surface 14*b* of the wall 14.

Figure 8:
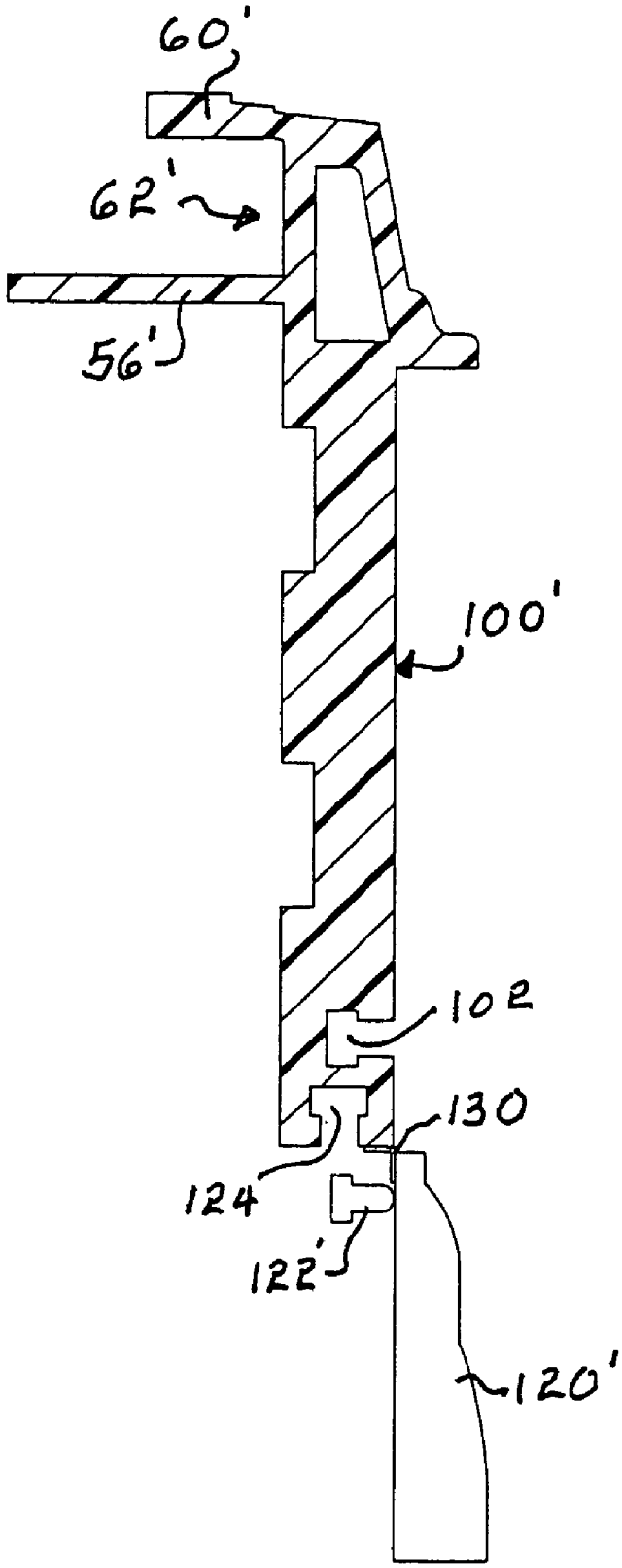
FIG. 8 is an elevation similar to FIG. 6 but showing an embodiment of the invention including interior molding extruded with the window sleeve.

FIG. 8 is an elevational view of a variation of the preferred embodiment of the invention wherein decorative interior molding 120' is attached to the window sleeve 100' by a hinge 130. In one variation the hinge 130 is extruded with either the window sleeve 100' or with the interior molding 120' and is attached to the interior molding 120' or to the window sleeve preferably by adhesive. In another variation the hinge 130 is a separate piece which is adhered to both the sleeve 100' and the interior molding 120'. In still another embodiment, the decorative interior molding 120' is coextruded with the window sleeve 100' with the hinge 130 being a thin unitary web connecting the molding to the sleeve.

It is to be understood that the molding 106, like the decorative interior molding 120' may also be attached to the window sleeve 100' by a hinge similar to the hinge 130 in FIG. 8. If the molding 106 is unitary or integral with the window sleeve 10 or 100, then the decorative interior molding 120 is initially detached from and snapped into the fitting, as shown in FIG. 7.

Figure 9:
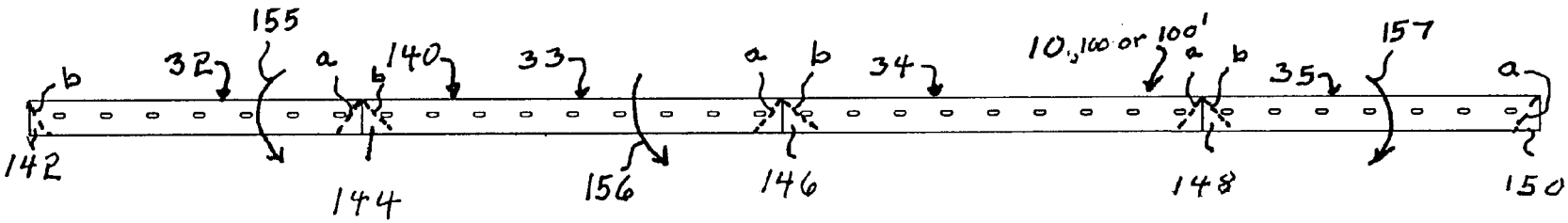
FIG. 9 is a view showing a window sleeve arrangement extrusion which is cut and folded to create the rectangular window sleeve arrangements of FIGS. 1–5, portions of which are shown in FIGS. 6–8.

Referring now to FIG. 9, there is shown an extrusion 140 comprising walls 32–35 of a single window sleeve arrangement 10, 100 or 100'. The extrusion 140 may be of any reasonable length and may have a length sufficient for several or many window sleeves 10, 100 or 100'. In the embodiment of FIG. 9, the extrusion 140 is severed at locations 142, 144, 146, 148 and 150 to form the separate walls 32, 33, 34 and 35, which walls are oriented perpendicular to one another to form a rectangular sleeve 10, 100 or 100'. In FIG. 9 the rectangle forming the sleeve 10, 100 or 100' is a square.

If it is desired that the window sleeve has a height that differs from its width, then the locations of the cuts 144, 146 and 148 are positioned so that the walls 32 and 34 each have a first length and the walls 33 and 35 have a second length, different from the first length so that the opening is rectangular as in FIGS. 1 and 3–5.

In accordance with one embodiment the cuts 142, 144, 146, 148 and 150 are equilateral triangles having cuts at 45° with respect to the extrusion 140 so that opposed edges a and b of each cut form a mitered corner when the edges a and b are placed in abutment.

The extrusion length 140 for one window sleeve 10, 100 or 100' may be cut leaving an apex portion c at each of the cuts 144, 146, and 148. The apex portions c provide hinges allowing the walls 32, 33 and 35 to be folded toward the wall 34 in the directions of arrows 155, 156 and 157. The abutting edges a and b are then bonded, adhered or fastened to one another to configure a rectangular window sleeve 10, 100 or 100'. Alternatively, the cuts 144, 146 and 148 may be made through the apecies c to separate the walls 32, 33, 34 and 35 completely, which walls are then reconnected by adhering, bonding or mechanically fastening the edges a and b to one another.

From the foregoing description, one skilled in the art can easily ascertain the essential characteristics of this invention, and without departing form the spirit and scope thereof, can make various changes and modifications of the invention to adapt it to various usages and conditions.

I claim:

1. A window sleeve arrangement independent of a window unit for positioning a window unit in a rectangular opening through a building wall having an exterior surface and an interior surface, wherein an enclosure wall separates an interior space defined by an enclosure defined by the building from an exterior space, the window unit having a window frame surrounding at least one glass pane; the window sleeve arrangement comprising:

upper and lower walls joined by side walls, the upper, lower and side walls each having an inner surface and an outer surface with the inner surfaces of the upper and lower walls being parallel to one another and the inner surfaces of the side walls being parallel to one another and perpendicular to the upper and lower walls to define a rectangular opening for slidably receiving the window unit and with the outer surfaces defining a rectangular box complementing the rectangular opening through the building wall, an inner edge of the walls configured for positioning adjacent to the interior surface of a building wall, and an outer edge of the walls for positioning adjacent to an exterior surface of a building wall; the upper, lower and side walls being a continuous extrusion of plastic material having abutting edges positioned at cuts through the continuing extrusion;

a first exterior flange disposed around the upper, lower and side walls of the window sleeve and extending laterally outward from the outer surfaces of the walls at a location intermediate the inner and outer edges of the walls, the first outer flange configured for engaging the exterior surface of a building wall and being secured to the exterior surface of the building wall to retain the window sleeve within the opening;

a second outer flange located substantially at the outer edges of the walls and spaced from the first outer flange defining a gap there between for receiving sheathing or an outer covering of the building;

an inner flange disposed adjacent to the outer edges of the walls and extending inwardly from the inner surface of the walls, the inner flange forming a stop configured for engaging an independent window unit to position a window unit within the sleeve in proximity with the exterior surface of an independent building wall, and an inside stop arrangement positioned in spaced relation to the inner flange to define a space therebetween configured for locating an independent window unit and for engaging an independent window unit to hold an independent window unit against the inner flange.

2. The window sleeve arrangement of claim 1 wherein the inside stop arrangement includes a molding strip constructed and arranged for engaging a window frame and wherein the inside stop arrangement includes grooves in the inner walls for receiving latching ribs projecting from the molding strip to hold the molding strip in place.

3. The window sleeve arrangement of claim 1 wherein the inside stop arrangement includes a molding strip for engaging an independent window unit, the molding strip having a connection for fastening the molding strip to the inner edges of the walls.

4. The window sleeve arrangement of claim 3 wherein the molding strip is fastened in place by separate fasteners, the separate fasteners being nails, screws, studs or staples.

5. The window sleeve arrangement of claim 1 wherein the first outer flange has a series of perforations for receiving fasteners therethrough.

6. The window sleeve arrangement of claim 5 wherein the fasteners are nails, screws, studs or staples.

7. The window sleeve arrangement of claim 1 wherein the inner surfaces of the walls extending from the inner edge to the inner flange are planar and unobstructed and wherein the shape and size of the space defined by the inner surfaces of the walls complements the shape and size of an independent window unit.

8. The window sleeve arrangement of claim 7 wherein the outer surfaces of the walls extending from the inner edge to the first outer flange are unobstructed complementing the opening through the enclosure wall.

9. The window sleeve arrangement of claim 1 wherein the plastic material is polyvinylchloride, polyurethane, polypropylene or ABS.

10. The window sleeve arrangement of claim 1 wherein the outer surfaces of the walls extending from the inner edge to the first outer flange are unobstructed and configured to complement the opening through the enclosure wall.

11. The window sleeve arrangement of claim 10 wherein the inner surfaces of the walls extending from the inner edge to the inner flange are planar and unobstructed and wherein the shape and size of the space defined by the inner surfaces of the walls complements the shape and size of an independent window unit.

12. The window sleeve arrangement of claim 11 wherein the first outer flange is configured for receiving fasteners therethrough.

13. The window sleeve arrangement of claim 12 wherein the fasteners are nails, screws, studs or staples.

14. The window sleeve arrangement of claim 13 wherein the window sleeve arrangement is molded of plastic material.

15. The window sleeve arrangement of claim 14 wherein the plastic material is polyvinylchloride, polyurethane or ABS.

16. The window sleeve arrangement of claim 1 wherein the sleeve arrangement further includes interior molding adapted to cover a portion of the interior surface of the building wall.

17. The window sleeve arrangement of claim 16 wherein the interior molding is attached to the window sleeve by a snap-in coupling.

18. The window sleeve assembly of claim 17 wherein the snap-in coupling comprises grooves in the outer edges of the walls and resilient latching ribs on the molding which are received in the grooves.

19. The window sleeve arrangement of claim 1 wherein the cuts are triangular and the abutting edges extend at 45° with respect to the longitudinal extent of the walls.

20. The window sleeve arrangement of claim 19 wherein the cuts do not extend completely through the walls and terminate at apecies of the cuts, wherein hinges occur at three of the apecies and wherein the window sleeve arrangement is formed upon folding the continuous extrusion at the apecies and joining the edges with bonds, adhesives or mechanical fasteners.

21. The window sleeve arrangement of claim 19 wherein the walls are completely severed at the abutting edges and joined by bonds, adhesive or mechanical fasteners.

22. The window sleeve arrangement of claim 16 wherein the interior molding is pivoted on the walls of the window sleeve arrangement at the inner edges thereof.

23. The window sleeve of claims 22 wherein the interior moldings are coextruded with the walls of the window sleeve arrangement.

* * * * *

UNITED STATES PATENT AND TRADEMARK OFFICE

CERTIFICATE OF CORRECTION

PATENT NO. : 7,165,364 B2
APPLICATION NO. : 10/676048
DATED : January 23, 2007
INVENTOR(S) : John D. Inelli It is certified that error appears in the above-identified patent and that said Letters Patent is hereby corrected as shown below:

Column 5, line 58, reads “first exterior flange” should read -- first outer flange --
Column 6, line 1, reads “there between” should read -- therebetween --
Column 8, line 1, reads “apecies” should read -- apices --
Column 8, line 2, reads “apecies” should read -- apices --
Column 8, line 4, reads “apecies” should read -- apices --
Column 8, line 12, reads “claims 22,” should read -- claim 22, --

Signed and Sealed this
Twenty-eighth Day of December, 2010

David J. Kappos

David J. Kappos
*Director of the United States Patent and Trademark Office*